US007308953B2

(12) United States Patent
Barnes

(10) Patent No.: US 7,308,953 B2
(45) **Date of Patent: *Dec. 18, 2007**

(54) MOBILE DRILLING RIG

(76) Inventor: R. Michael Barnes, 3303 FM 1960 West, Suite 230, Houston, TX (US) 77068

( * ) Notice: Subject to any disclaimer, the term of this patent is extended or adjusted under 35 U.S.C. 154(b) by 289 days.

This patent is subject to a terminal disclaimer.

(21) Appl. No.: 11/069,787

(22) Filed: Mar. 1, 2005

(65) Prior Publication Data

US 2005/0194189 A1 Sep. 8, 2005

Related U.S. Application Data

(60) Provisional application No. 60/549,485, filed on Mar. 2, 2004.

(51) Int. Cl.
*E21B 15/00* (2006.01)
*E04H 12/34* (2006.01)

(52) U.S. Cl. ..... 175/203; 175/122; 52/118; 52/119; 52/120

(58) Field of Classification Search ..... 166/379; 175/122, 57, 102, 203, 219, 85; 52/143, 52/651.05, 745.17, 118, 119, 120
See application file for complete search history.

(56) References Cited

U.S. PATENT DOCUMENTS 2,577,642 A * 12/1951 Woolslayer et al. ..... 52/118
3,807,109 A * 4/1974 Jenkins et al. ..... 52/120
3,922,825 A * 12/1975 Eddy et al. ..... 52/116
4,135,340 A * 1/1979 Cox et al. ..... 52/115
4,305,237 A * 12/1981 Borg et al. ..... 52/116
4,489,526 A * 12/1984 Cummins ..... 52/125.6
4,759,414 A * 7/1988 Willis ..... 175/170
4,821,816 A * 4/1989 Willis ..... 175/57
4,899,832 A * 2/1990 Bierscheid, Jr. ..... 173/187
5,109,934 A * 5/1992 Mochizuki ..... 175/170
5,711,382 A * 1/1998 Hansen et al. ..... 175/52
6,848,515 B2 * 2/2005 Orr et al. ..... 173/1
6,962,030 B2 * 11/2005 Conn ..... 52/741.1
6,994,171 B2 * 2/2006 Orr et al. ..... 173/28
2002/0166698 A1 * 11/2002 Beato et al. ..... 175/7
2003/0102166 A1 * 6/2003 Jortveit ..... 175/162
2004/0206551 A1 * 10/2004 Carriere et al. ..... 175/203
2004/0211598 A1 * 10/2004 Palidis ..... 175/162
2005/0194189 A1 * 9/2005 Barnes ..... 175/122
2006/0027373 A1 * 2/2006 Carriere et al. ..... 166/379
2006/0260844 A1 * 11/2006 Patton et al. ..... 175/52

* cited by examiner

*Primary Examiner*—Jennifer H. Gay
*Assistant Examiner*—Shane Bomar
(74) *Attorney, Agent, or Firm*—Buskop Law Group, PC; Wendy Buskop

(57) ABSTRACT

An embodied mobile drilling rig is made of three sections, two substructures and a mast section, which are easily transported and installed at a drilling site. Each substructure includes a mast starting section; a floor side box connected to the mast starting section; a subbase side box; elevating legs connected to the floor side box and the subbase side box; and a raising cylinder. The mast section connects to the mast starting sections. The raising cylinders engage the mast in order to raise the mast into a vertical orientation and then raise the floor side boxes into an operating position. The embodied mobile drilling rigs are configurable to be transported by road with as little as three major loads, all within legal or permitable load and dimensional limits for most regions.

31 Claims, 17 Drawing Sheets

MOBILE DRILLING RIG

CROSS REFERENCES TO RELATED APPLICATIONS

The present application claims priority to now abandoned U.S. Provisional Patent Application Ser. No. 60/549,485, filed on Mar. 2, 2004.

FIELD

The present embodiments relate to mobile drilling rigs.

BACKGROUND

In the current art, drilling rigs or workover rigs with a hook capacity between 450 kips and 500 kips represent the upper limit for rigs with a mast and drawworks package that can be transported on a single trailer within legal or permit able road transportation limitations. Above this capacity, single trailer packaging is not achievable with a full-height mast with traveling equipment and a top drive pre-strung with wireline without grossly exceeding practical road weight limitations.

Although single trailer packaging of a mast is expected for smaller capacity operations for efficient mobilization, this upper limit capacity with the single trailer packaging presents compromises to design that distinguish the limited rig from a "full blown drilling rig". Adherence to this type of packaging results in limitations of drawworks design, of working space on the floor, of mast flexibility, of mast durability, of mast stability, of floor height, of BOP height, and of allowable accessories. Extensive use of high-strength steel and extremely light design for components make the structural integrity inherently more critical or prone to and sensitive to damage that inevitably occurs in normal operations. Commonly, the mast or other components are removed and separately transported for legal road transport in many regions.

Many of the current single trailer or carrier rig designs treat the substructure somewhat as an afterthought. The packaging of the substructure for road transport, assembly, and erection is rarely given adequate attention.

In a fully capable, modern drilling package with a mud system with tanks, engine power and control modules, well control equipment, as well as other significant packages to complete, the mast and substructure represent only a portion of the total. Overall efficient packaging of the entire rig does not end with the mast and substructure.

One of the most notable deficiencies in mobile or "fast moving" rig packaging is the inability to move efficiently between wells a short distance apart. This major shortcoming is critical in some drilling operations that have wells in a cluster or single row. In these installations, the operator needs a rig to move very quickly (a few hours or less) between wells that are typically thirty meters or less apart from each other.

Most rig substructures are configured so that the rig must be completely rigged down to make these short moves. Other substructures have openings that allow skidding without rigging down, but have the disadvantage that the mast must be installed and laid down along the direction of the well row. This configuration is not acceptable because of the danger of the mast falling on a completed wellhead.

Current methods for modifying existing drilling rigs to allow them to move efficiently from well-to-well are very costly. The single trailer packaging does not lend itself to efficient well-to-well moves. The current art does not teach of any mobile or "fast moving" rigs that adequately address short well-to-well moves.

Some rig packages compromise on the mast height. Limitations to doubles or singles compromise on tripping efficiency and are not acceptable to many operators if a treble mast is available as an alternative.

A need, therefore, exists for a drilling rig that does not go beyond legal transportation limits, but also provides efficient installation and assembly, minimum rig up site requirement, scalability of rig capacity, mobility, well-to-well skidding, and winterization possibilities not found in the current art.

BRIEF DESCRIPTION OF THE DRAWINGS

In the detailed description of the embodiments presented below, reference is made to the accompanying drawings, in which.

Figure 1:
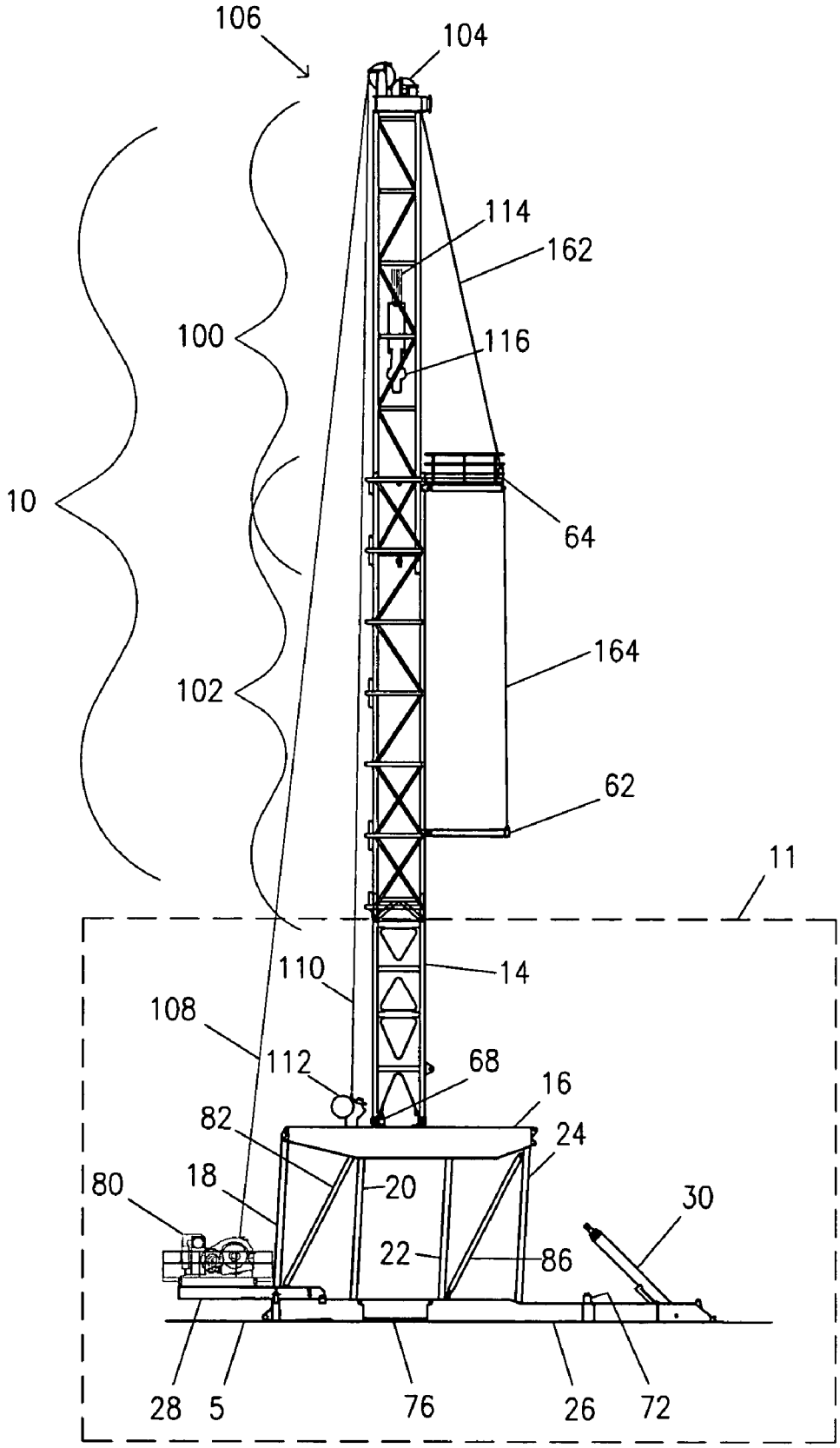
FIG. 1 depicts a driller's side view of an embodiment of a mobile drilling rig fully erected at a drilling site.

The present embodiments are detailed below with reference to the listed Figures.

DETAILED DESCRIPTION OF THE EMBODIMENTS

Before explaining the present embodiments in detail, it is to be understood that the embodiments are not limited to the particular descriptions and that it can be practiced or carried out in various ways.

The present embodiments relate to a mobile drilling or workover rig. The mobile drilling rig is an efficient assembly of equipment that allows the rig to be transported and installed easily and quickly. The embodied mobile drilling rigs include a unique substructure design that allows well-to-well access along a row of multiple wells. The substructure allows existing wellheads to be cleared since the subbase center section is removable leaving a large clear opening. Further, since the mast assembly can install and raise perpendicular to the row of wells, the embodied mobile drilling rigs can safely clear the existing wellheads.

The embodied mobile drilling rigs can be configured to be transported by road with as little as three major loads, all within legal or permitable load and dimensional limits for most regions. Assembly of the rig is accomplished without cranes or special equipment and requires minimal time and man hours and is safer in comparison with the assembly of rigs in the known art. The single-load mast transportation reduces rig-up complexity. The integration of braces with the transported loads eliminates the need to handle loose components and minimizes field connections.

The embodied mobile drilling rigs are capable of being equipped with modern equipment including AC power, top drive, driller's control cabin, and other similar pieces of equipment needed in drilling operations. The embodied mobile drilling rigs provide a reduced pad size requirement and improve cellar access for BOP handling.

The methods for installing a mobile drilling rig at a drilling site provide a minimal rig-up sequence that is fast, efficient, safer, and does not require a crane or special equipment. The embodied mobile drilling rigs have a low assembly height, around five feet in most cases, which allow loads to be offloaded from the truck and dolly without the need for intermediate handling. The mast and drawworks installations are not sequence dependent allowing for better hook-up time. The doghouse and driller's cabin can be raised with the drill floor. The methods include utilizing the same telescopic cylinders for raising the mast and substructure, thereby reducing manual intervention during transportation, rig-up, erection, or dismantling.

An embodiment of a mobile drilling rig includes a mast section, a driller's side substructure, and an off-driller's side substructure. All three sections are mobile and meet legal load and dimensional limits for road transportation in most regions.

The mast section can include an upper section that nest within and a lower section in a telescoping fashion. Each substructure includes a mast starting section and a floor side box connected to the mast starting section. Each substructure includes one or more elevating legs that engage the floor side box and a subbase side box. Each substructure section includes a subbase side box and one or more raising cylinders that are connected to the subbase side box and mast starting section. The lower end of the mast starting section engages the mast starting sections.

The methods entail transporting the mobile drilling rig to the drilling site. The mobile drilling rig is transported in three sections: a mast section; a driller's section; and an off-driller's section. The driller's and off-driller's sections each include a substructure, a mast starting section located on the substructure, and raising cylinders connected to the substructure and the mast starting section. The mast and substructure can be installed together at the same time as the generators and other rig equipment because the installation activity for the mast and substructure occurs primarily in the area forward of the well, while the installation activity of the other rig equipment occurs primarily in the area in the rear of the well.

The driller's and off-driller's sections are positioned parallel to one another at the drilling site. The mast is positioned to the mast starting section. The mast and mast starting sections are raised into a vertical orientation using the raising cylinders on the each of the substructures.

The method continues by raising the drill floor on each section to an intermediate height using the intermediate raising cylinders disposed in each separate section. The raising cylinders are retracted from the mast raising position on the mast starting section and engaged in the drill floor raising position. The drill floors are raised using the raising cylinders. Braces connecting the drill floor to the subbase are then locked in place.

Figure 4:
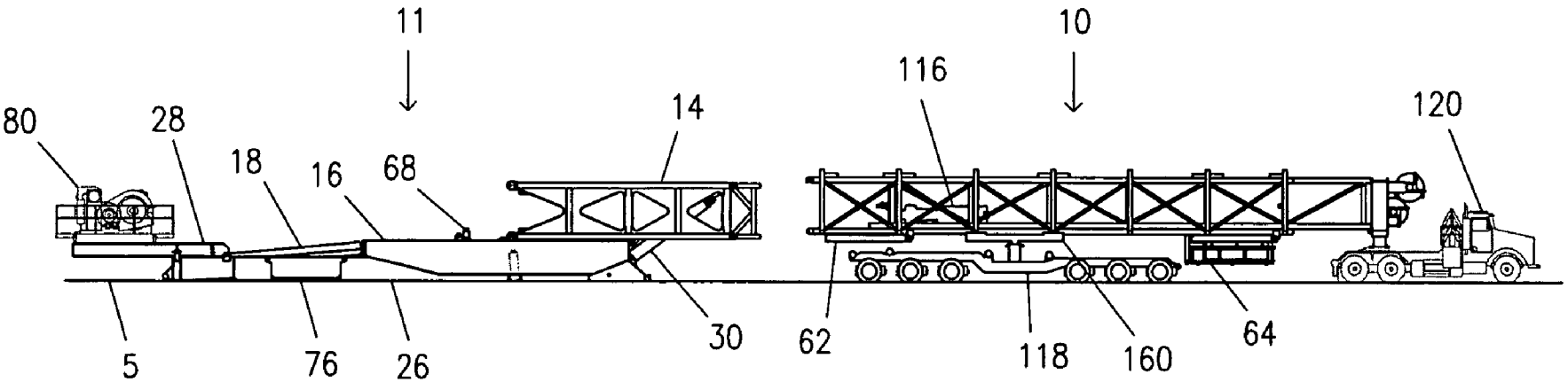
FIG. 4 depicts a side view of the driller's side substructure after offloading and a mast transported on a multiple axle dolly and prepared for engagement with the mast starting sections.

With reference to the figures, FIG. 1 depicts a driller's side view of an embodiment of a mobile drilling rig (106) fully erected at a drilling site (5). FIG. 1 shows the mast (10) fidly erected with a belly board (62) and racking board (64). The mast includes an upper section (100) that can nest within the lower section (102) when retracted, as depicted in FIG. 4.

A mobile drilling rig can include a hoisting assembly that includes drawworks (80), fastline (108), a crown (104), drill lines (114), deadline (110) and a deadline anchor (112). The drawworks can rest on a driller's drawworks support frame (28). The off-driller's support structure can include a drawworks support frame as well. FIG. 1 shows the fast line (108) extended from the drawworks (80) to the crown (104). A deadline (110) can extend from the crown (104) to the deadline anchor (112), which can be located on the floor side box. FIG. 1 shows the traveling block (116) suspended from the crown (104) by the drill lines (114). The embodied drilling rig can include braces connected to the driller's elevating legs and/or the subbase side box and the floor side box. FIG. 1 depicts the driller's braces (82 and 86) connected to a driller's floor side box (16) and a driller's subbase side box. The off-driller's braces are not shown in the side view of FIG. 1. The driller's and off-driller's brace can be telescoping braces. Multiple elevating legs (18), (20), (22), and (24) connect between the subbase side box and the drill floor side box.

A mobile drilling rig is transported to the site (5) in at least three sections: a driller's side substructure (11), an off-driller's side substructure (38), and a mast (10). The three sections are depicted in FIG. 2A, FIG. 2B, FIG. 3, and FIG. 4. The three sections are transported to the site (5) using normal transportation means, such as a truck or trucks and dollies.

Figure 2A:
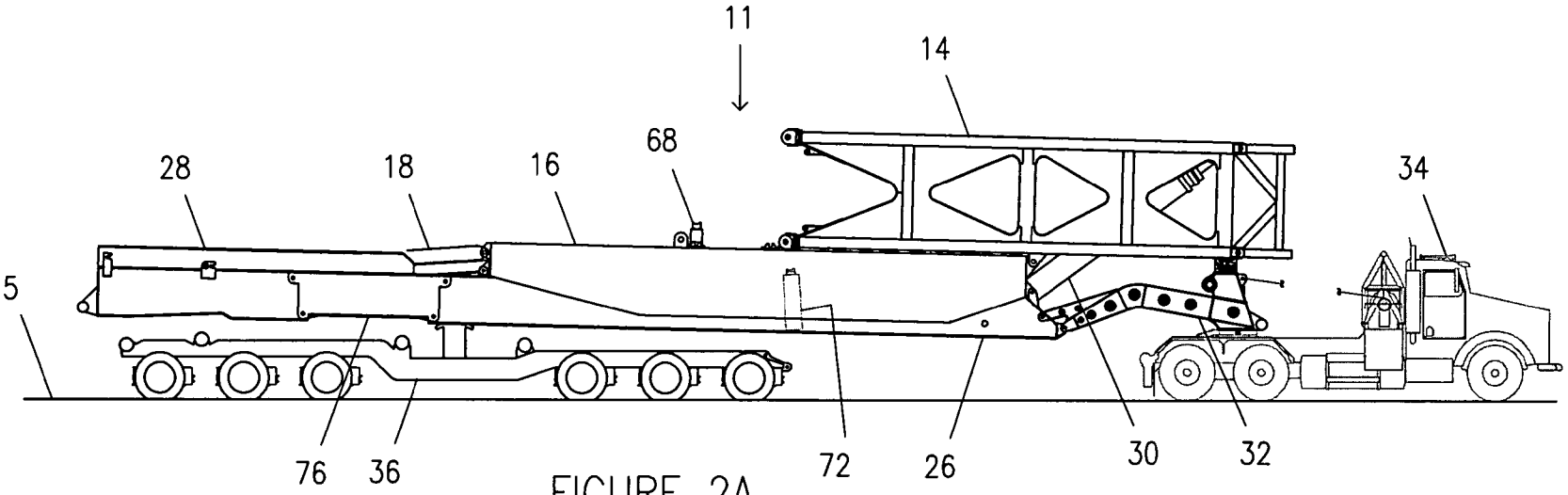
FIG. 2A depicts a side view of an embodiment of a driller's side substructure transported on a truck and a multiple axle dolly.

FIG. 2A depicts a driller's side substructure (11) and mast starting section transported on a first truck (34) and a first multiple axle dolly (36). A driller's side substructure (11) includes a first mast starting section (14) and a driller's floor side box (16) that is connected to the first mast starting section (14). A driller's side substructure (11) includes two or more driller's elevating legs that engage the driller's floor side box (16). Only one driller's elevating leg (18) is visible in FIG. 2A from the side view. A driller's subbase side box (26) engages the driller's elevating legs (18). The driller's substructure (11) includes a drawworks support frame (28), which is shown retracted for compactness during transportation. A driller's side substructure (11) includes a driller's raising cylinder (30) that is connected to the driller's subbase side box (26) and the first mast starting section (14). The first truck and second truck can be the same truck. One substructure can be delivered to the drilling site and the same truck can be used to transport the other substructure in a second transport trip.

As depicted in FIG. 2A, the first truck (34) can connect to a driller's gooseneck (32), which is connected to the driller's subbase side box (26). The first mast starting section (14) rests on the driller's gooseneck (32). The first multiple axle dolly (36) engages the driller's subbase side box (26) and supports the driller's side substructure (11).

FIG. 2A further shows the location of the driller's snubbing cylinder (68) located on the driller's floor side box (16). The driller's intermediate cylinder (72) is shown on the driller's subbase side box (26) in order to initiate raising the driller's floor side box (16).

Figure 2B:
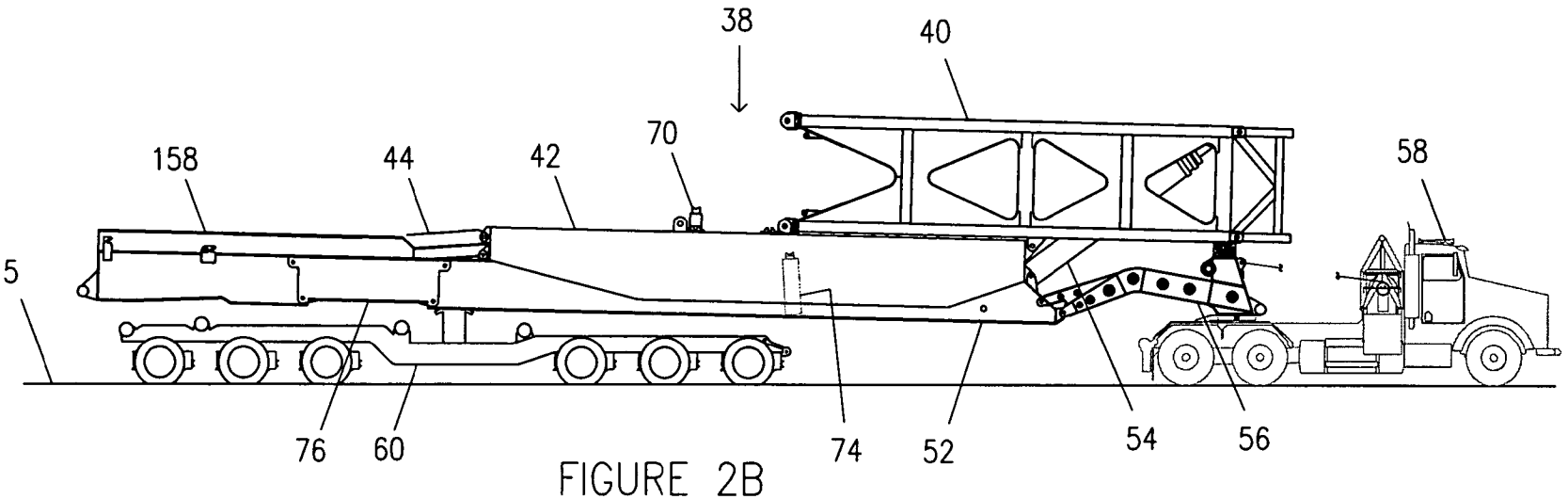
FIG. 2B depicts a side view of an embodiment of an off-driller's side substructure transported on a truck and a multiple axle dolly.

FIG. 2B depicts an off-driller's side substructure (38) and mast starting section transported on a second truck (58) and a second multiple axle dolly (60). In the simplest form, an off-driller's side substructure (38) is a mirror image of a driller's side substructure (11). An off-driller's side substructure (38) includes a second mast starting section (40) and an off-driller's floor side box (42) that is connected to the second mast starting section (40). An off-driller's side substructure (38) includes two or more off-driller's elevating legs that engage the off-driller's floor side box (42). Only one off-driller's elevating leg is visible in FIG. 2B from the side view (44). An off-driller's subbase side box (52) engages the off-driller's elevating legs (44). The off-driller's substructure (38) includes a drawworks support frame (158) shown retracted for compactness during transportation. An off-driller's side substructure (38) includes an off-driller's raising cylinder (54) that is connected to an off-driller's subbase side box (52) and a second mast staffing section (40).

As depicted in FIG. 2B, the second truck (58) can include an off-driller's gooseneck (56) connected to the off-driller's floor side box (42). The second mast starting section (40) rests on the off-driller's gooseneck (56). The second multiple axle dolly (60) engages the off-driller's floor side box (42) and supports the off-driller's side substructure (38).

FIG. 2B further shows the location of the off-driller's snubbing cylinder (70) located on the off-driller's subbase side box (52). An off-driller's intermediate cylinder (74) is shown on the off-driller's subbase side box (52) in order to initiate raising the off-driller's subbase side box (52).

The mast (10) is transported in a horizontal orientation on a mast truck (120) with a mast dolly (118) resting on a support cradle (160), as shown in FIG. 4. The mast (10) has a small road transportation package, a minimum rig-up space requirement, and a low raising cylinder load.

Figure 3:
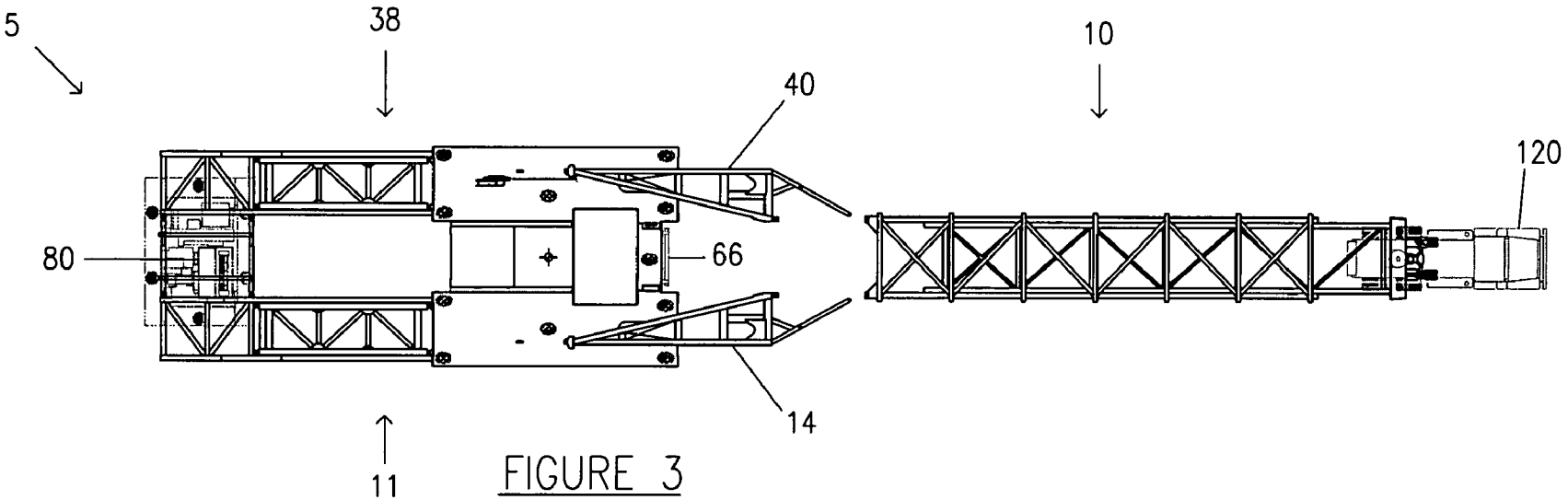
FIG. 3 depicts a top view of the orientation of a driller's side substructure, an off-driller's side substructure, and a mast before engagement with the mast starting sections.

As depicted in FIG. 3, a driller's side substructure (11) and an off-driller's side substructure (38) are situated parallel and in a mirrored position to one another at the drilling site (5). FIG. 4 depicts the driller's side substructure (11) after unloading from a truck (34) and a dolly (36) at a drilling site (5).

The mast starting section legs are widely spaced to allow for a comfortable working space on the floor. The floor space is not compromised by narrow mast as configured in most mobile rigs.

The mast (10) is aligned to the mast starting sections (14 and 40) and brought towards the mast starting sections (14 and 40) using a truck (120) or other similar means, as depicted in FIG. 4. The top end of the mast (10) goes over the end of the mast starting sections (14 and 40) by using an elevating bolster located on the dolly or by using the raising cylinders. The mast starting sections (14 and 40) engage the mast (10) using a connection, such as a hook and pin engagement. When the upper connection of the mast (10) is connected to an individual mast starting section, the bottom connection of the mast (10) can be connected to the same starting section.

After the mast (10) is coupled to the mast starting sections (14 and 40), the truck (120) is removed from the mast (10).

Figure 5:
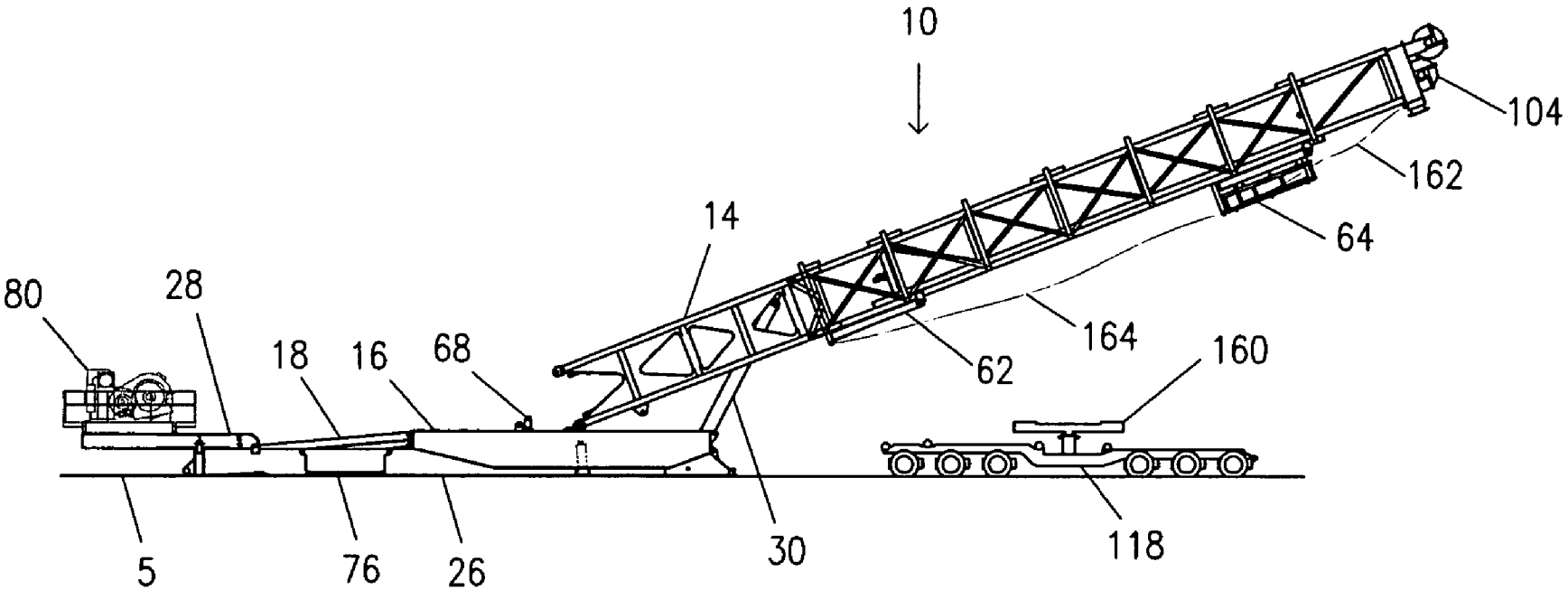
FIG. 5 depicts a driller's side view of a mast in the first stages of raising the mast into position.

FIG. 5 depicts the mast (10) being raised to a vertical orientation by actuating the raising cylinders (30 and 54); the off-driller's is not depicted in FIG. 5 due to the side view. The mast (10) can include a racking board (64) and a belly board (62). The racking board (64) and a belly board (62) can be folded into the mast (10) during transportation, as depicted in FIG. 4 and FIG. 5. When the mast (10) is being raised to a vertical orientation, the racking board (64) and a belly board (62) can be manually or automatically extended or telescoped to an operating height.

The mast (10), the first mast starting section (14), and the second mast starting section (40) are then raised into an essentially vertical orientation using the driller's raising cylinder (30) and the off-driller's raising cylinder (54), simultaneously.

Figure 6:
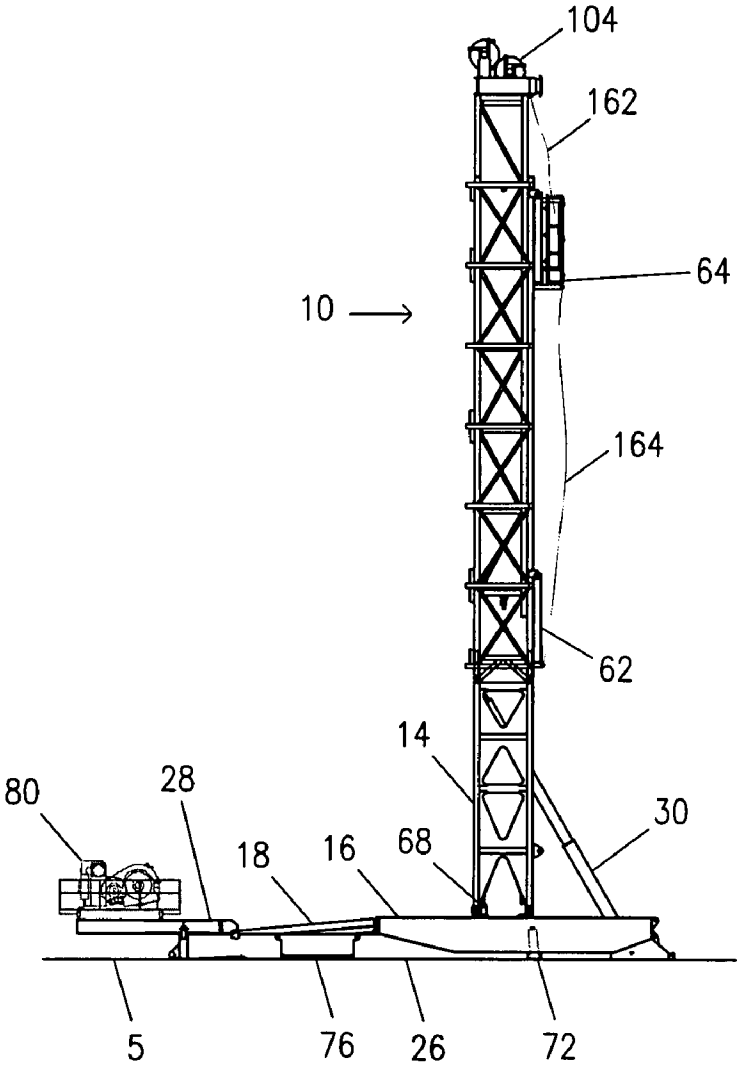
FIG. 6 depicts a driller's side view of a mast after raising to a vertical orientation with a mast snubbing cylinder cradling the mast.

In order to prevent the mast (10) from coming to rest on the substructure with excessive forces and to keep the mast from tipping uncontrollably due to inertia once the mast approaches the vertical orientation, each substructure can include a mast snubbing cylinder (68 and 70) to cushion the mast. FIG. 6 depicts a side view of a mast after rising to a vertical orientation with a mast snubbing cylinder cradling the mast.

Once the mast (10) and the mast starting sections (14 and 40) are in the vertical orientation, a rear mast shoe on each section is pinned to secure the respective mast starting section (14 and 40) to the respective drill floor side box (16 and 42). FIG. 6 depicts the mast (10) in the vertical orientation.

The efficient design and arrangement of the raising cylinders (30 and 54) can keep the cylinders to three stages as compared to four or more on most current designs. The ability to use the same raising cylinders for mast and substructure raising steps reduces costs and complexity of rig-up. The cylinders can be double acting for full retraction of the rods for protection and longer use life. The retraction ports can be located on the cylinder barrel, thereby avoiding cumbersome external piping and hoses to the cylinder rod end.

Figure 8:
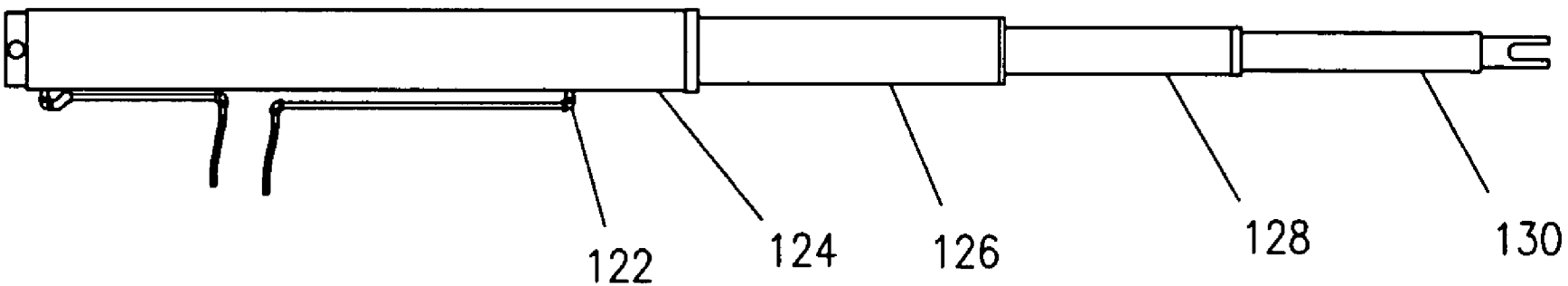
FIG. 8 depicts a side view of an embodiment of a raising cylinder.

FIG. 8 depicts a side view of a raising cylinder (54). The figure shows the embodiment of the three rods (126, 128, and 130) extending from the cylinder barrel (124). The raising cylinder (54) can include a retraction port (122) to actuate the three rods (126, 128, and 130) to return inside of the cylinder barrel (124). The raising cylinders are used in raising the mast and the drill floor and can be located in a cradle in the substructure.

Figure 7:
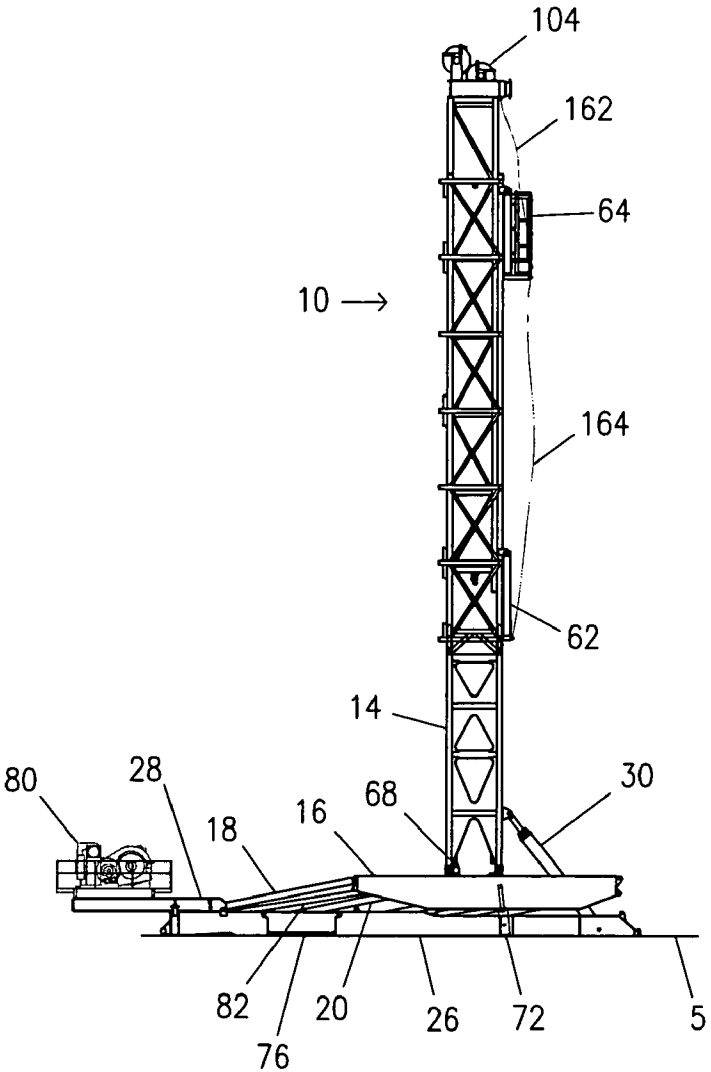
FIG. 7 depicts a driller's side view of the mast and substructure raised to the intermediate height, wherein raising cylinders are retracted and engaged in the substructure raising shoe.

The drill floor side boxes (16 and 42) are raised to an intermediate height using the intermediate raising cylinders (72 and 74). FIG. 7 depicts the driller's floor side box (16) positioned to the intermediate height. FIG. 7 is driller's side view so the off-driller's components are not shown.

The intermediate raising cylinders (72 and 74) are typically connected to the subbase side boxes (26 and 52) and engage the drill floor side boxes (16 and 42) by a raising shoe.

After the mast (10) and the mast starting sections (14 and 40) are in the vertical orientation and the drill floor side boxes (16 and 42) have been raised to the intermediate height, the raising cylinders (30 and 54) are retracted and follow a guide in each respective mast starting sections (14 and 40) and engage into a shoe in each respective mast starting section (14 and 40). The first and second raising cylinders (30 and 54) are engaged with the mast starting sections (14 and 40) using a method allowing for a push compression action. Once the first and second raising cylinders (30 and 54) are engaged with the respective shoes on the respective mast starting sections (14 and 40), the raising cylinders (30 and 54) begin to raise the respective drill floor side boxes (16 and 42).

Figure 9:
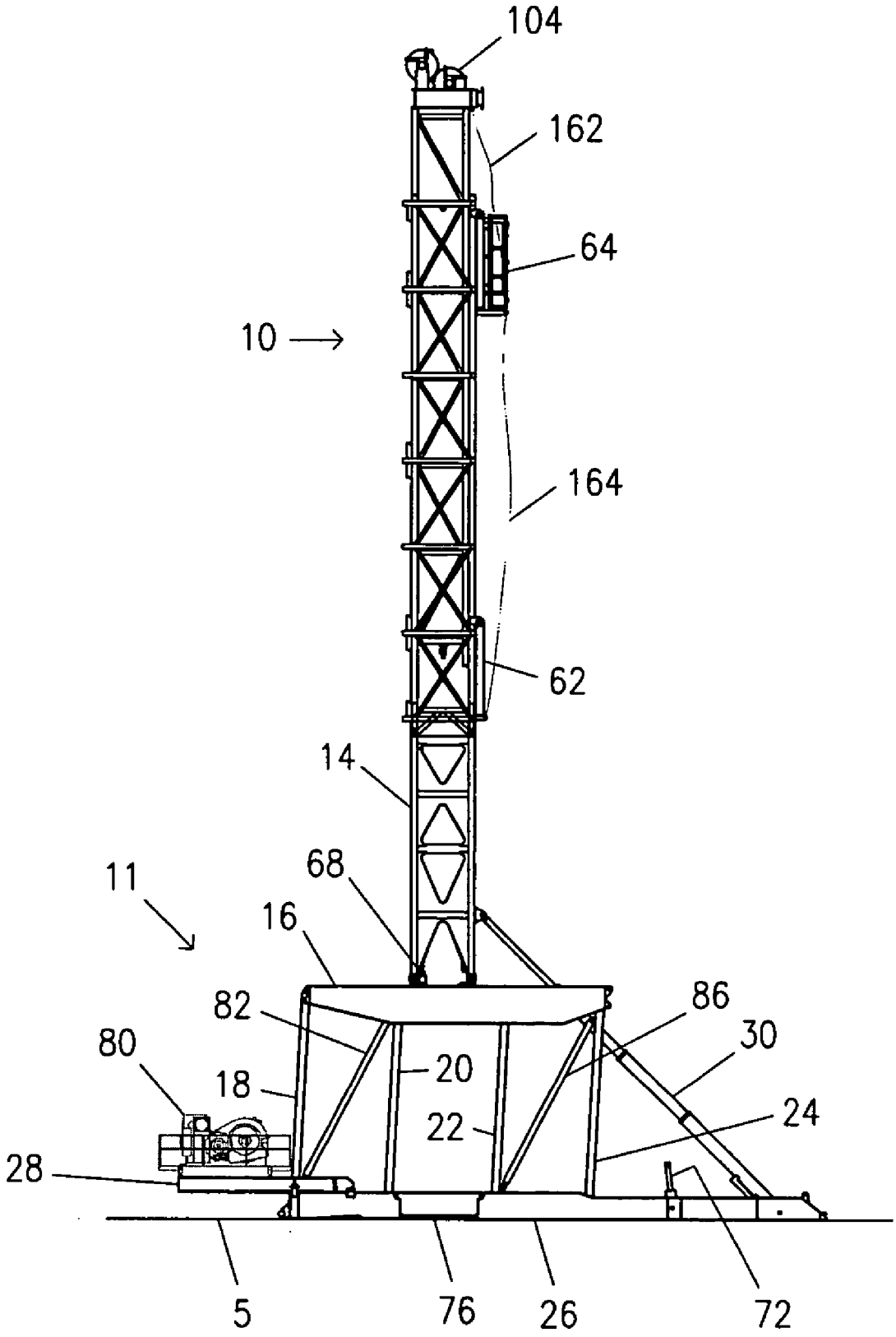
FIG. 9 depicts a driller's side view of the mast and substructure, wherein raising cylinders are raising the drill floor from the intermediate height to the operating height.

FIG. 9 depicts a driller's side view wherein the raising cylinders are continuing to raise the drill floor from the intermediate height to the operating height.

Figure 10:
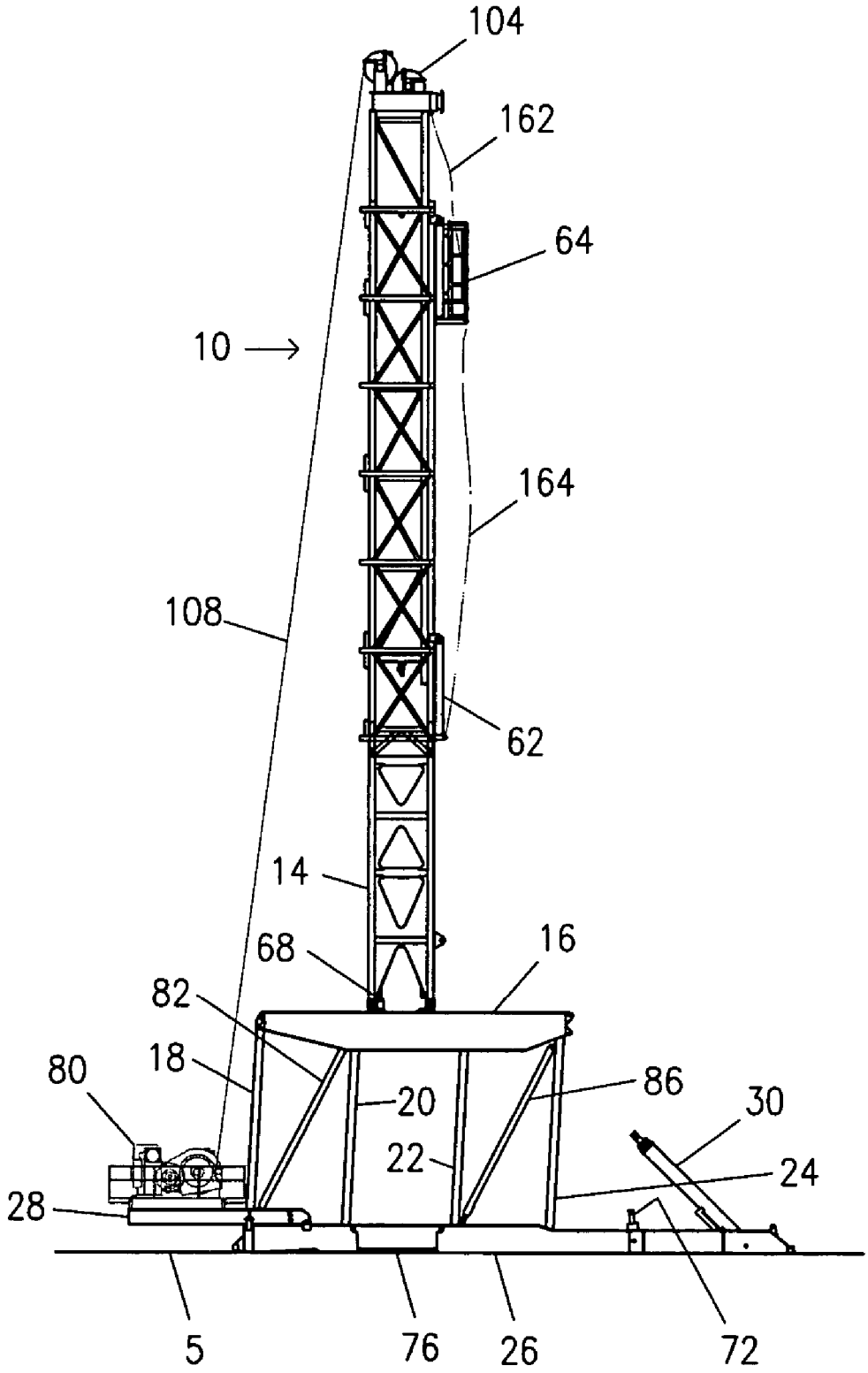
FIG. 10 depicts a driller's side view of the mast and substructure raised to an operating height, wherein raising cylinders are retracted and a wire line extends from a drawworks.

The drill floor side boxes (16 and 42) are finally raised to the operating height using the raising cylinders (30 and 54). FIG. 10 depicts the mobile drilling rig erected at a drilling site (5) with the drill floor side boxes (16 and 42) at the operating height. Once the drill floor side boxes (16 and 42) are raised, the braces (82 and 86) are locked into place to stabilize the drill floor side boxes (16 and 42). FIG. 10 depicts the drill floor at the operating height, the raising cylinders retracted, and the wire line on a drawworks.

Figure 11:
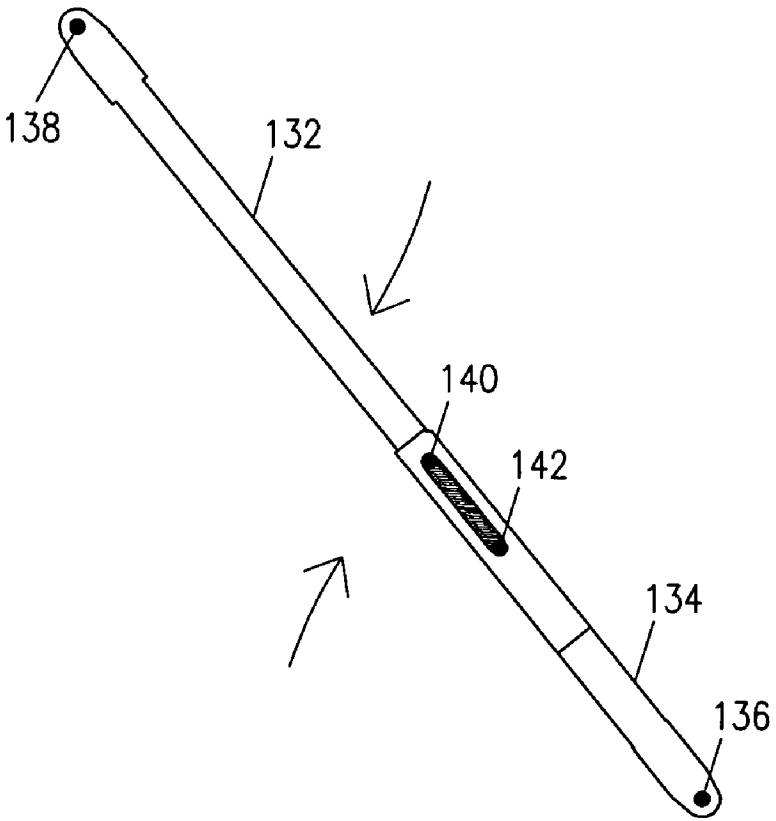
FIG. 11 depicts an embodiment of braces used to interconnect the driller's side substructure and off-driller's side substructure.

FIG. 11 depicts an embodiment of a brace, which is a component of the bracing system that connects the driller's side substructure to the off-driller's side substructure. FIG. 11 shows the male brace portion (132) inserted into the female brace portion (134) until the correct length is obtained. The male brace portion (132) is attached to the female brace portion (134) by the use of locking pins (140 and 142). The brace portions (132 and 134) and connected to the structure itself using locking pins (136 and 138).

The mast (10) on the drilling rig can be a telescoping mast. The telescoping mast can be raised using a hydraulic cylinder that keeps drawworks (80) power-up out of the critical path of rig-up sequence. FIG. 1 depicts the mobile drilling rig with telescoping mast fully erected at a drilling site (5). Installation of the mast can be done on the pipe lay down side of a drilling site (5) and contributes to the minimum rig-up space requirement.

The drawworks (80) is installed simultaneously with the mast allowing for better hook-up time. The doghouse and driller's cabin are raised simultaneous with the drill floor. The assembly requires few field assembly connections. Further, minimum space is required on the drawworks (80) side of the rig since the rig is not installed from that side. The low assembly height means that the rig is easily offloaded from truck or trailer bed heights to the assembled position without intermediate handling. The integration of the crown, traveling equipment, and wire line reel contributes to fast rig-up. The assembled floor and substructure arrangement lends itself to efficient winterization.

An embodiment of the mobile drilling rig includes a center drill floor section inserted between, and connected to, the driller's side floor side box and the off-driller's floor side box. FIG. 3 depicts the third drill floor center section (66). A raising cylinder can be located in the center drill floor, in addition to or exclusive of, the raising cylinders in the substructures. The raising cylinder in the center section can be connected to the mast in order to raise the mast and the drill floor.

Figure 12:
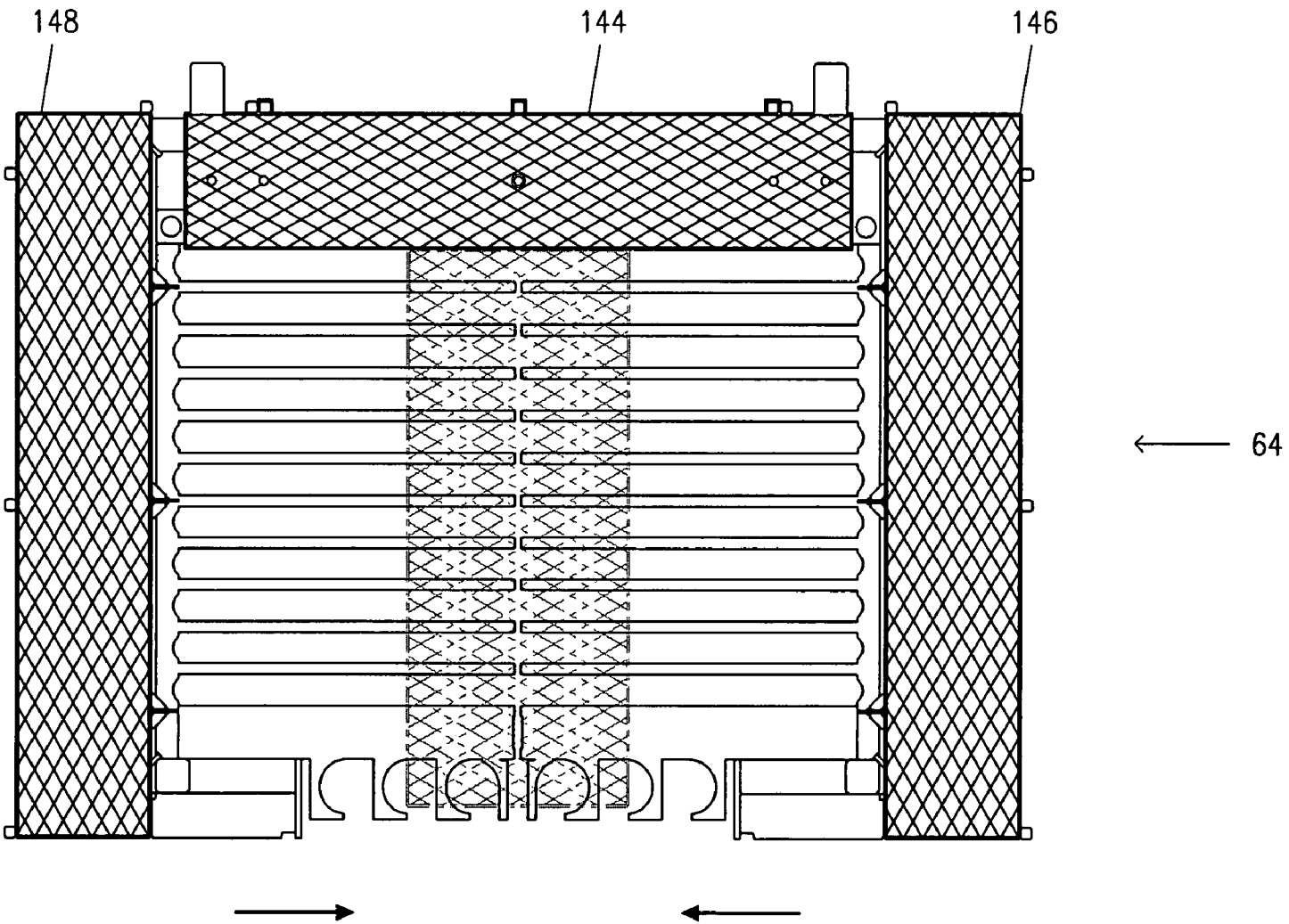
FIG. 12 depicts an embodiment of an adjustable racking board in a transport configuration.
Figure 13:
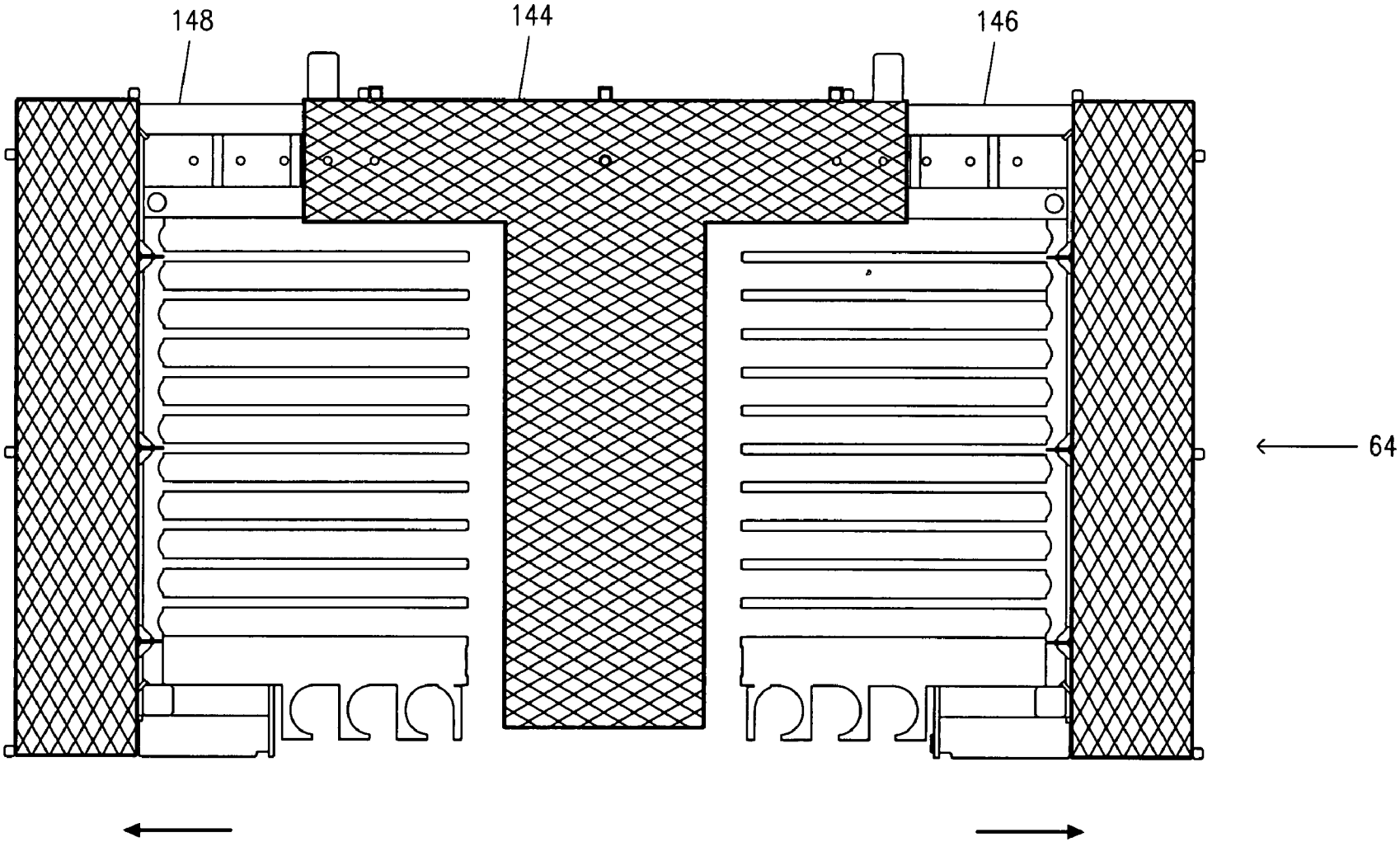
FIG. 13 depicts an embodiment of an adjustable racking board in an operational configuration.

As discussed above, the mast (10) can include a racking board (64) and a belly board (62) that can be folded into the mast (10) during transportation, as depicted in FIG. 4 and FIG. 5. The racking board suspension lines (162) and the belly board suspension lines (164) are shown in Fig 1. FIG. 12 depicts an adjustable racking board (64) in a transport configuration, wherein the outside racking frames (146 and 148) are located near the main racking frame (144). FIG. 13 depicts an adjustable racking board (64) in an operational configuration, wherein the outside racking frames (146 and 148) slide away from the main racking frame (144) creating a larger working area.

Figure 14:
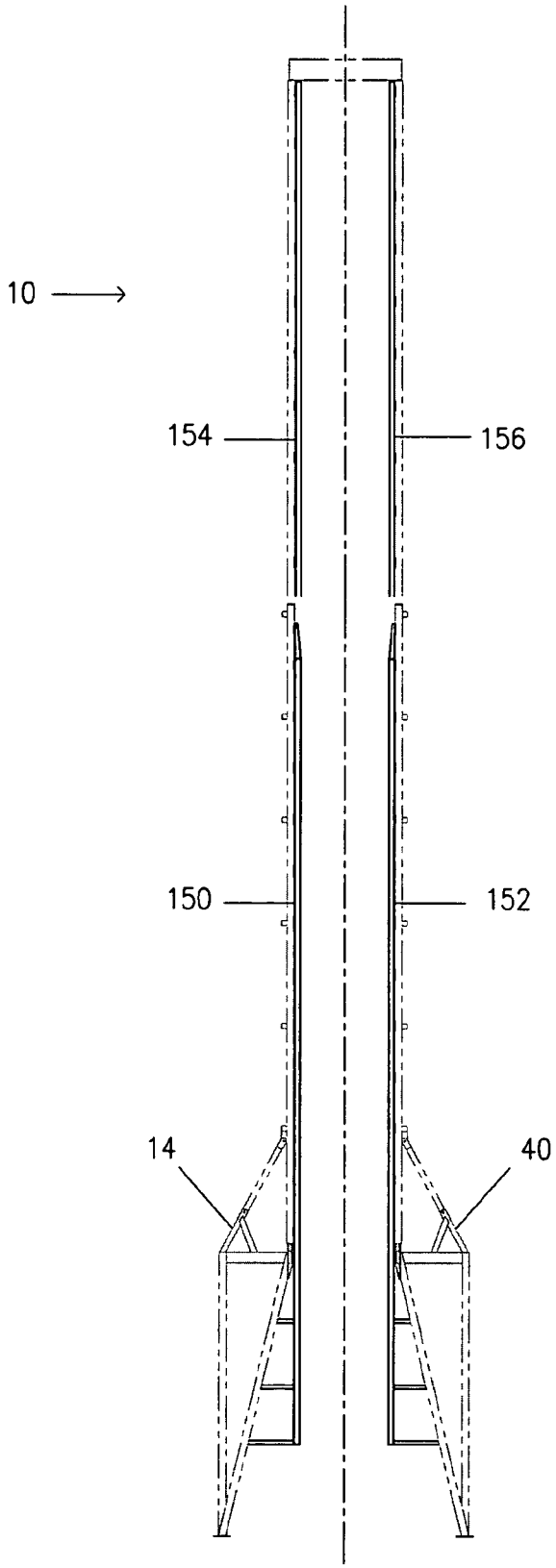
FIG. 14 depicts an elevation of the top drive guide rails usable with the embodied mobile drilling rig.
Figure 15:
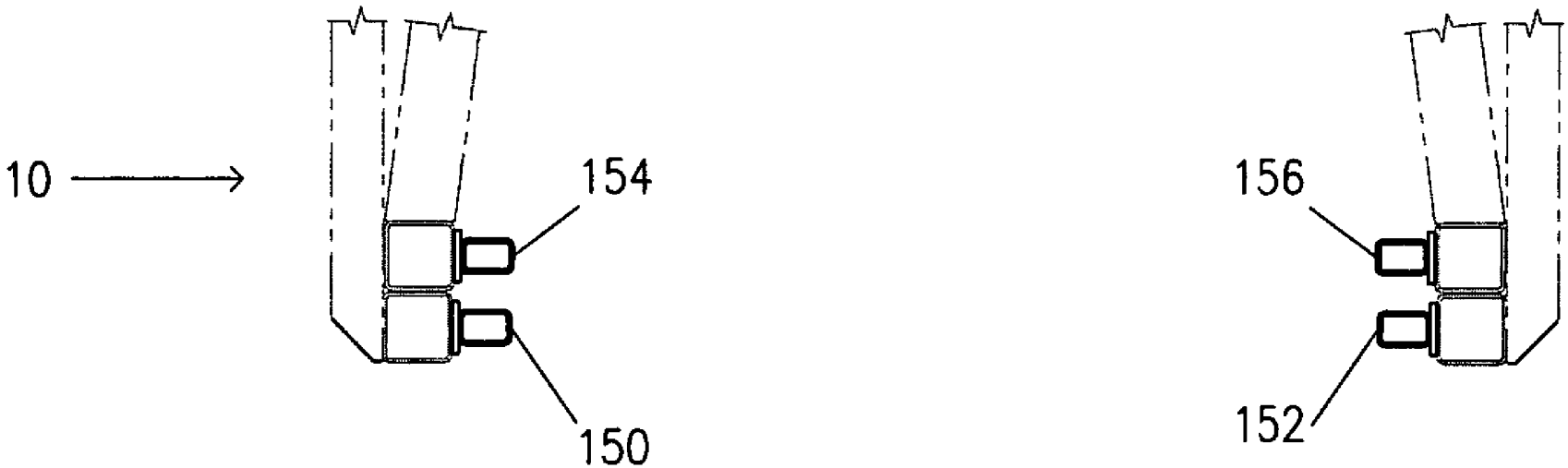
FIG. 15 depicts a cross sectional detail view of the top drive guide rails showing the relationship of the upper section guide rails and the lower section guide rails.

FIG. 14 depicts an elevation view of the top drive guide rails in the telescoping mast (10). FIG. 15 depicts a cross sectional detail view of the top drive guide rails showing the relationship of the upper section guide rails (154 and 156) and the lower section guide rails (150 and 152).

Figure 16:
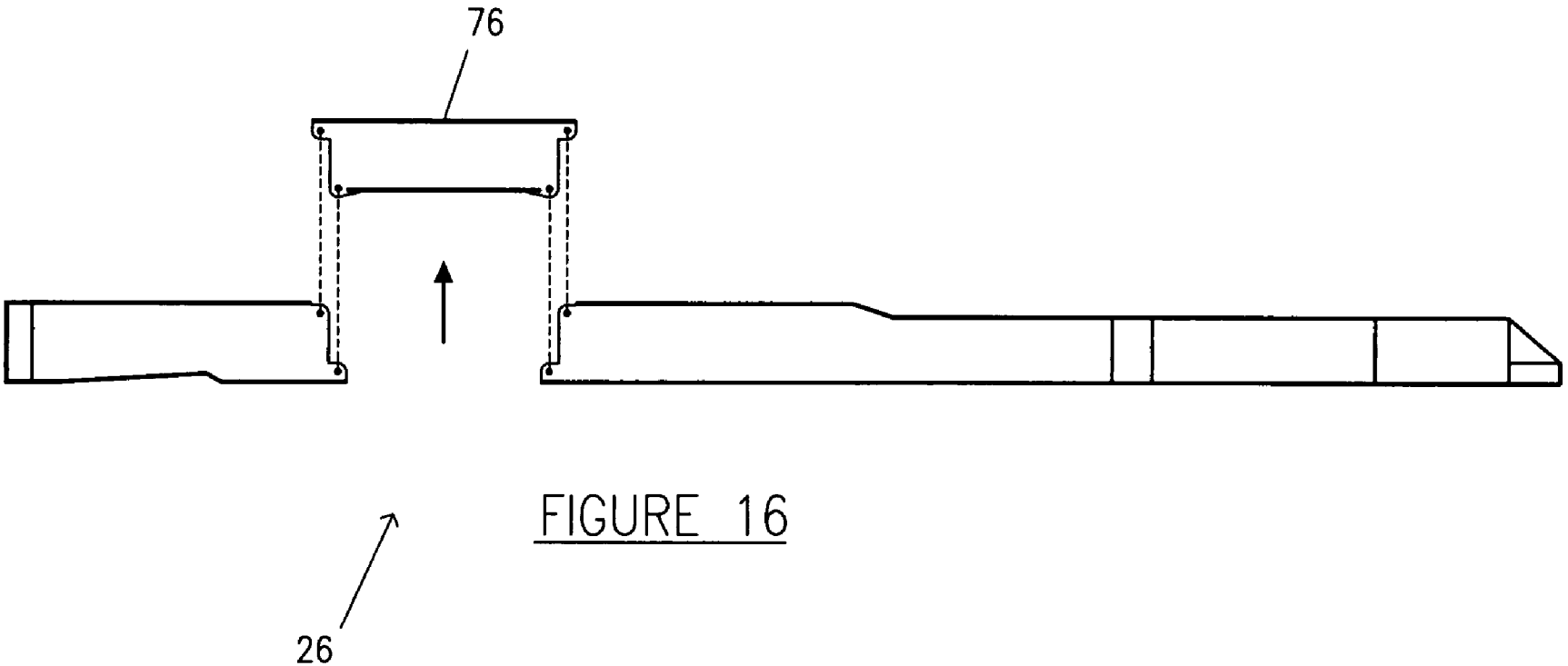
FIG. 16 depicts a side view of the substructure subbase with removable center section to allow multiple well access of the rig.

The drilling rig can be moved from one well to another well clearing existing wellheads. FIG. 16 depicts an aspect of the embodied mobile drilling rig to accommodate multiple wells. Each substructure can include a subbase center section that is removable to permit operational access to a rig cellar and clearance to skid over existing wellheads. FIG. 16 depicts an embodiment of the driller's side subbase center section (76) as removable from the driller's subbase side box (26).

The mast can be raised perpendicular to a row of wells and the substructure has a generous wellhead skid clearance making the rig efficient for multiple well operations. The cellar can be opened along the well row allowing skidding from well to well without rigging down.

Figure 17:
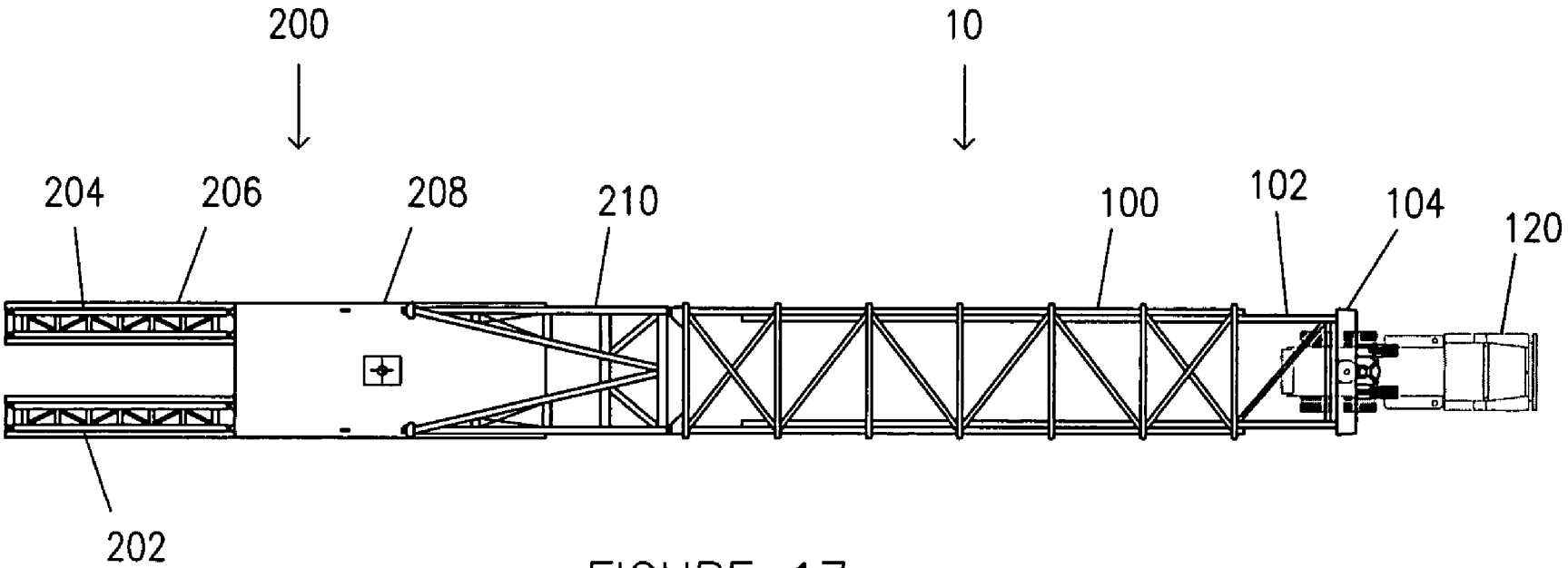
FIG. 17 depicts an embodiment of a mobile drilling rig that can include a mast and a single unit substructure assembly.

FIG. 17 depicts an embodiment of a mobile drilling rig that can include a mast and a single unit substructure assembly (200). The single unit substructure assembly (200) comprises a single mast starting section (210); a drill floor (208) connected to the mast starting section; and two or more elevating legs (202 and 204) connected to the drill floor (208). The single unit assembly includes a subbase (206) that engages the elevating legs (202 and 204). The single unit assembly includes one or more raising cylinders connected to the subbase (206) and the mast starting section (210). The mast starting section (210) is positioned for transport on top of the drill floor (208) and the raising cylinder is connected to the mast starting section (210) and the subbase (206).

Fully erected, the embodied mobile drilling rigs can range in sizes and capacities and still incorporate the novel benefits described herein. The table below lists example specifications of various embodiments of the mobile drilling rigs:

| | Model 1100 | Model 770 | Model 550 |
|---|---|---|---|
| Hook Capacity | 1100 kips | 770 kips | 550 kips |
| Mast Height | 147 ft | 136 ft | 136 ft |
| Mast Width @ Floor Level | 22 ft | 22 ft | 22 ft |
| Lines to Block | 12 | 10-12 | 10 |
| Setback Capacity | 660 kips | 500 kips | 350 kips |
| Floor Height | 30 ft | 26 ft | 22 ft |
| Clearance Under Rotary | 26 ft | 22 ft | 18 ft |

The embodiments have been described in detail with particular reference to certain embodiments thereof, but it will be understood that variations and modifications can be effected within the scope of the embodiments, especially to those skilled in the art.

What is claimed is:

1. A mobile drilling rig comprising:

a. a mast comprising an upper end and a lower end;

b. a driller's side substructure comprising a first mast starting section; a driller's floor side box connected to the first mast starting section; a first driller's elevating leg; a second driller's elevating leg, wherein the first and second driller's elevating legs engage the driller's floor side box; a driller's subbase side box engaging the first and second driller's elevating legs; and a driller's raising cylinder engaging the driller's subbase side box;

c. an off-driller's side substructure comprising a second mast starting section; an off-driller's floor side box connected to the second mast starting section; a first off-driller's elevating leg; a second off-driller's elevating leg, wherein the first and second driller's elevating legs engage the off-driller's floor side box; an off-driller's subbase side box engaging the first and second off-driller's elevating legs; and an off-driller's raising cylinder engaging the off-driller's subbase side box;

wherein the lower end engages the first mast starting section and the second mast starting section;

a first guide independently formed into the first starting mast section and a second guide formed into the second starting mast section;

wherein the driller's raising cylinder follows the first guide and engages a first shoe independently formed into the first mast section when the first starting mast section is in a substantially vertical orientation;

the off-driller's raising cylinder follows the second guide and engages a second shoe formed in the second mast section when the first mast starting section and second mast starting section are in a substantially vertical orientation; and wherein when the driller's raising cylinder is engaged with the first shoe the driller's raising cylinder raises the driller's side substructure and when the off driller's raising cylinder is engaged with the second shoe the off-driller's raising cylinder lifts the driller's side substructure.

2. The mobile drilling rig of claim 1, further comprising a first truck with a first dolly and a second truck with a second dolly, wherein the first mast starting section rests on the first truck, wherein the second mast starting section rests on the second truck, wherein the first dolly engages the driller's subbase side box and supports the driller's side substructure, and wherein the second dolly engages the off-driller's subbase side box and supports the off-driller's side substructure.

3. The mobile drilling rig of claim 2, wherein the first truck comprises a driller's gooseneck connected to the driller's subbase side box, wherein the first mast starting section rests on the driller's gooseneck, wherein the second truck comprises an off-driller's gooseneck connected to the off-driller's subbase side box, and wherein the second mast starting section rests on the off-driller's gooseneck.

4. The mobile drilling rig of claim 1, further comprising a driller's snubbing cylinder disposed on the driller's floor side box and an off driller's snubbing cylinder disposed on the off-driller's floor side box, wherein the snubbing cylinders are adapted to control the mast in the final stages of raising.

5. The mobile drilling rig of claim 1, further comprising a driller's intermediate cylinder disposed on the driller's subbase side box and an off-driller's intermediate cylinder disposed on the off-driller's subbase side box, wherein the intermediate cylinders are adapted to initiate raising of the driller's floor side box and the off-driller's floor side box.

6. The mobile drilling rig of claim 1, further comprising a subbase center section, wherein the center section is removable to permit operational access to a rig cellar and to nearby wells.

7. The mobile drilling rig of claim 1, further comprising a driller's brace and an off-driller's brace, wherein the driller's brace is connected to the driller's elevating legs, and wherein the off-driller's brace is connected to the off-driller's elevating legs.

8. The mobile drilling rig of claim 1, further comprising a driller's brace and an off-driller's brace, wherein the driller's brace is connected to the driller's subbase side box and the driller's floor side box, and wherein the off-driller's brace is connected to the off driller's subbase side box and the off-driller's floor side box.

9. The mobile drilling rig of claim 1, wherein the mast is a telescoping mast.

10. The mobile drilling rig of claim 9, wherein the telescoping mast is raised by a telescoping cylinder or a drawworks with a wireline.

11. The mobile drilling rig of claim 1, wherein the mast further comprises a racking board and a belly board.

12. The mobile drilling rig of claim 11, wherein the racking board is adapted to be in a first contracted position for transport and in a second position for operation.

13. The mobile drilling rig of claim 1, wherein the mast further comprises a crown with hoist assembly.

14. The mobile drilling rig of claim 13, wherein the hoist assembly comprises a fastline, a deadline, a plurality of drill lines, and a traveling block, wherein the fastline engages the crown and a drawworks, wherein the deadline engages the crown and a deadline anchor, and wherein the plurality of drill lines engages the traveling block and the crown.

15. The mobile drilling rig of claim 1, wherein said driller's side substructure further comprises a driller's drawworks support frame, and wherein the off-driller's side substructure further comprises an off driller's drawworks support frame.

16. A mobile drilling rig comprising:

a. a mast;

b. a single unit assembly comprising:

i. a mast starting section;

ii. a drill floor connected to the mast starting section;

iii. a plurality of legs engaging the drill floor;

iv. a subbase engaging the elevating legs; and v. a raising cylinder for raising the mast and the drill floor;

wherein the mast starting section is positioned for transport on top of the drill floor, and wherein the raising cylinder is disposed within the mast starting section and is connected to the subbase.

17. The mobile drilling rig of claim 16, further comprising a truck with a dolly, wherein the mast starting section rests on the truck, wherein the dolly engages the subbase and supports the drill floor.

18. The mobile drilling rig of claim 17, wherein the truck comprises a gooseneck connected to the subbase, and wherein the mast starting section rests on the gooseneck.

19. The mobile drilling rig of claim 16, further comprising a gooseneck, a truck, and a multiple axle dolly, wherein the gooseneck is connected to the subbase, wherein the truck carries the mast starting section resting on the gooseneck, and wherein the multiple axle dolly engages the subbase and supports the single unit assembly.

20. The mobile drilling rig of claim 16, further comprising a snubbing cylinder disposed on the subbase, wherein the snubbing cylinder is adapted to control the mast in the final stages of raising.

21. The mobile drilling rig of claim 16, further comprising an intermediate cylinder disposed on the subbase, wherein the intermediate cylinder is adapted to initiate raising the drill floor.

22. The mobile drilling rig of claim 16, further comprising a removable center to permit operational access to a rig cellar and to nearby wells.

23. The mobile drilling rig of claim 16, further comprising a brace connecting to the elevating legs.

24. The mobile drilling rig of claim 16, further comprising a brace connecting to the subbase and the drill floor.

25. The mobile drilling rig of claim 16, wherein the mast is a telescoping mast.

26. The mobile drilling rig of claim 25, wherein the telescoping mast is raised by a telescoping cylinder or a drawworks with a wireline.

27. The mobile drilling rig of claim 16, wherein the mast further comprises a racking board and a belly board.

28. The mobile drilling rig of claim 27, wherein the racking board is adapted to be in a first contracted position for transport and in a second position for operation.

29. The mobile drilling rig of claim 16, wherein the single unit assembly further comprises a drawworks support frame.

30. The mobile drilling rig of claim 16, wherein the hoist assembly comprises a fastline, a deadline, a plurality of drill lines, and a traveling block, wherein the fastline engages the crown and a drawworks, wherein the deadline engages the crown and a deadline anchor, and wherein the plurality of drill lines engages the traveling block and the crown.

31. A mobile drilling rig comprising:

a. a mast comprising an upper end and a lower end;

b. a driller's side substructure comprising a first mast starting section; a driller floor side box connected to the first mast staffing section; a first driller's elevating leg;

a second driller's elevating leg, wherein the first and second driller's elevating legs engage the driller's floor side box; and a driller's subbase side box engaging the first and second driller's elevating legs;

c. an off-driller's side substructure comprising a second mast starting section; an off-driller's floor side box connected to the second mast starting section; a first off-driller's elevating leg; a second off-driller's elevating leg, wherein the first and second driller's elevating legs engage the off-driller's floor side box; and an off-driller's subbase side box engaging the first and second off-driller's elevating legs; and d. a center section comprising a raising cylinder, wherein the center section is disposed between the driller's side substructure and the off-driller's side substructure, wherein the cylinder is connected to the mast wherein the lower end engages the first mast starting section and the second mast starting section.

* * * * *